US011512917B2

(12) United States Patent
Turnblom

(10) Patent No.: US 11,512,917 B2
(45) Date of Patent: Nov. 29, 2022

(54) WIPED MUZZLE DEVICE

(71) Applicant: SILENCERCO, LLC, West Valley City, UT (US)

(72) Inventor: Jacob Scott Turnblom, West Valley City, UT (US)

(73) Assignee: SILENCERCO, LLC, West Valley City, UT (US)

( * ) Notice: Subject to any disclaimer, the term of this patent is extended or adjusted under 35 U.S.C. 154(b) by 0 days.

(21) Appl. No.: 17/001,601

(22) Filed: Aug. 24, 2020

(65) Prior Publication Data

US 2021/0389076 A1 Dec. 16, 2021

Related U.S. Application Data

(63) Continuation-in-part of application No. 16/899,265, filed on Jun. 11, 2020.

(51) Int. Cl.

| | |
|---|---|
| ***F41A 21/36*** | (2006.01) |
| ***F41A 21/32*** | (2006.01) |
| ***F41A 21/34*** | (2006.01) |
| ***F41A 21/30*** | (2006.01) |

(52) U.S. Cl.

CPC ..... *F41A 21/36* (2013.01); *F41A 21/30* (2013.01); *F41A 21/325* (2013.01); *F41A 21/34* (2013.01)

(58) Field of Classification Search

CPC ..... F41A 21/30; F41A 21/34; F41A 21/36; F41A 21/325

See application file for complete search history.

(56) References Cited

U.S. PATENT DOCUMENTS

| | | | | | |
|---|---|---|---|---|---|
| 2,449,571 | A * | 9/1948 | Walker | F41A 21/30 | 89/14.4 |
| 3,667,570 | A * | 6/1972 | WerBell, III | F41A 21/30 | 181/223 |
| 3,677,132 | A * | 7/1972 | Plenge | F41A 35/02 | 89/14.2 |
| 3,713,362 | A * | 1/1973 | Charron | F41A 21/30 | 89/14.4 |
| 4,530,417 | A * | 7/1985 | Daniel | F41A 21/30 | 181/223 |
| 5,078,043 | A * | 1/1992 | Stephens | F41A 3/62 | 181/223 |
| 5,966,858 | A * | 10/1999 | Curtis | F41A 21/32 | 42/1.14 |
| 7,237,353 | B1 * | 7/2007 | Beauchamp | F41A 21/36 | 42/1.14 |
| 10,180,300 | B2 * | 1/2019 | Schirmer | F41A 21/28 | |
| 10,760,867 | B2 * | 9/2020 | Davis | F41A 21/36 | |
| 10,767,952 | B1 * | 9/2020 | Till | F41A 21/36 | |
| 10,794,651 | B2 * | 10/2020 | Crown | F41A 21/30 | |
| 2020/0340777 | A1 * | 10/2020 | Yoon | F41A 21/32 | |

* cited by examiner

*Primary Examiner* — Joshua T Semick

(74) *Attorney, Agent, or Firm* — Holland & Hart LLP

(57) ABSTRACT

A wiped muzzle device, such as a compensator, brake or flash suppressor. The wipe improves the function of the muzzle device by forcing muzzle blast gases through the ports or vents to either counter the force vector created by the muzzle blast gases or alter the mixing of gases to reduce muzzle flash.

20 Claims, 11 Drawing Sheets

32
38
46
50

38
38

16
32
38

46
38

16

32
38
56
50
46

12
32
38
38
46

56
35
16
50
46

38
35
38
46

62
16
18
38

38
46

35
16
50
16

38
46

32
38
46

38
16
18

WIPED MUZZLE DEVICE

CROSS-REFERENCE TO RELATED APPLICATIONS

This application is a continuation-in-part to U.S. application Ser. No. 16/899,265 filed 11 Jun. 2020, entitled Wipe-Cutting Tool.

TECHNICAL FIELD

The present disclosure relates generally to a wiped muzzle feature for any device other than a sound suppressor. More particularly, the disclosure relates to integrating a wipe into a muzzle brake, flash suppressor/hider, or compensator to improve the function of the muzzle device.

BACKGROUND

Firearm muzzle devices come is a wide variety of shapes, sizes and configurations to accomplish the same basic objective of the device. A muzzle brake or recoil compensator is an accessory that redirects a portion of propellant gases escaping the muzzle to counter recoil and muzzle rise. Devices incorporating the concept of a muzzle brake are used in a variety forms for rifles and pistols to reduce recoil and muzzle rise, muzzle flip, or muzzle climb (used interchangeably) to refer to the tendency of a handheld firearm's front end (the muzzle end of the barrel) to rise after firing. Firearms with less height from the grip line to the barrel centerline tend to experience less muzzle rise.

Muzzle rise occurs when the centerline of the barrel is above the center of contact between the shooter and the firearm's grip and stock. The force exerted by the fired bullet and expanding propellant gases exiting the muzzle act directly down the centerline of the barrel. The greater the distance between the centerline and the center of the contact point, the greater the rotational force, which causes the firearm to rotate and the muzzle to rise.

Muzzle brakes operate on the basic principle of counteracting that rotational force by diverting combustion gases from the muzzle end of the bore in a direction away from forward the muzzle of the bore. Gases leaving the muzzle travel in the same vector as the bullet, creating recoil and muzzle rise. To counter muzzle rise compensators redirect gases through vents. Redirecting the expanding gas reduces the force in the direction of recoil. The angle toward which the gases are directed changes the direction of the force exerted on the muzzle eg. gases directed upward will exert a downward force and counteract muzzle rise.

Some vents direct gases laterally, thus reducing recoil by reducing the amount of gases expanding in the direction of the projectile. Recoil is further attenuated through vents that redirect the gases in the opposite direction of travel of the bullet, i.e. towards the shooter, effectively cancelling the force vector created by the expanding gases.

Wipe elements or "wipes," are replaceable baffles used in sound suppressors. Early wipes were manufactured disks made of a penetrable membranes made of soft material, such as rubber or felt. During their manufacturing, a series of disks separated by annular spacers were placed transversely to the shooting axis. The suppressor was mounted on a muzzle and when fired, the projectile passed through the wipes, creating a hole of the same caliber as the projectile. The wipe formed a seal around each projectile as it passed through the wipe so as to inhibit the escape of propellant gases from the suppressor. Modifying the compensator to direct more gases through the compensator vents would improve the performance of the compensator. Thus a need exists for directing gases through the compensator.

BRIEF SUMMARY

The general purpose of the systems and methods disclosed herein is to provide an improved muzzle device. Specifically, the disclosure describes a wipe integrated into any muzzle device other than a sound suppressor. The overall apparatus comprises a muzzle accessory, such as a brake, compensator, and/or flash suppressor configured to receive a wipe. This apparatus is designed to work in conjunction with a variety of muzzle devices, which are either muzzle accessories or that have been integrated into the muzzle of a firearm, but it could also be included in conjunction with cannons or other guns which employ a compensator.

In a non-limiting embodiment, the apparatus comprises a wiped compensator. In some embodiments, the wiped compensator comprises a body member defining a bore. In some embodiments, the body member comprises a feature such as at least one port or aperture forming vent holes which extend through the body member wherein the body member has a barrel mounting end and a muzzle end. Some embodiments comprise a mounting cap affixed to the barrel mounting end of body member. In some embodiments, the mounting cap is adapted to receive the barrel of the firearm. In some embodiments, a muzzle cap affixed to the muzzle end of the body member wherein the muzzle cap defines an opening aligned with the barrel of the firearm to permit projectile egress. In some embodiments, a receptacle is formed within the body member adjacent to said muzzle cap configured to receive a wipe. In some embodiments, the receiver positions the wipe transversely a firing axis of a firearm.

Reference throughout this specification to features, advantages, or similar language does not imply that all of the features and advantages that may be realized with the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment, but may refer to every embodiment.

Furthermore, described features, advantages, and characteristics may be combined in any suitable manner in one or more embodiments. One skilled in the relevant art will recognize that the disclosure may be practiced without one or more of the specific features or advantages of a particular embodiment. In other instances, additional features and advantages may be recognized in certain embodiments that may not be present in all embodiments.

The features and advantages of the present disclosure will become more fully apparent from the following description and appended claims, or may be learned by practice as set forth hereinafter.

BRIEF DESCRIPTION OF THE DRAWINGS

In order to describe the manner in which the advantages and features of the embodiments can be obtained, a more particular description of the disclosure briefly described above will be rendered by reference to specific embodiments thereof which are illustrated in the appended drawings.

Understanding that these drawings depict only typical embodiments and are not therefore to be considered to be limiting of its scope, the disclosure will be described and explained with additional specificity and detail through the use of the accompanying drawings in which.

DETAILED DESCRIPTION

Figure 1:
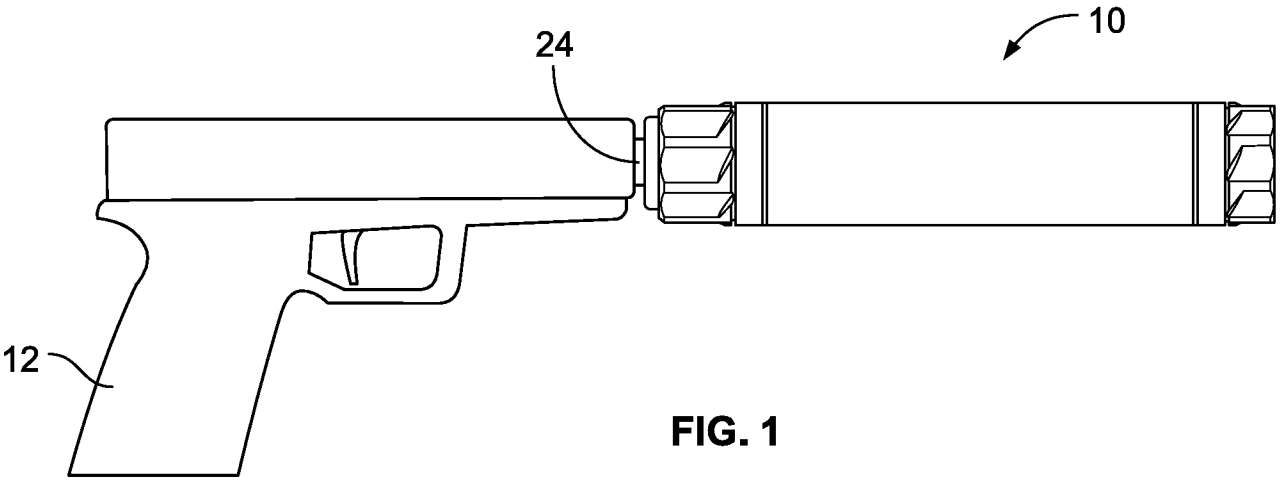
FIG. 1 is a side view of a firearm having an example silencer or sound suppressor according to at least one embodiment.
Figure 2:
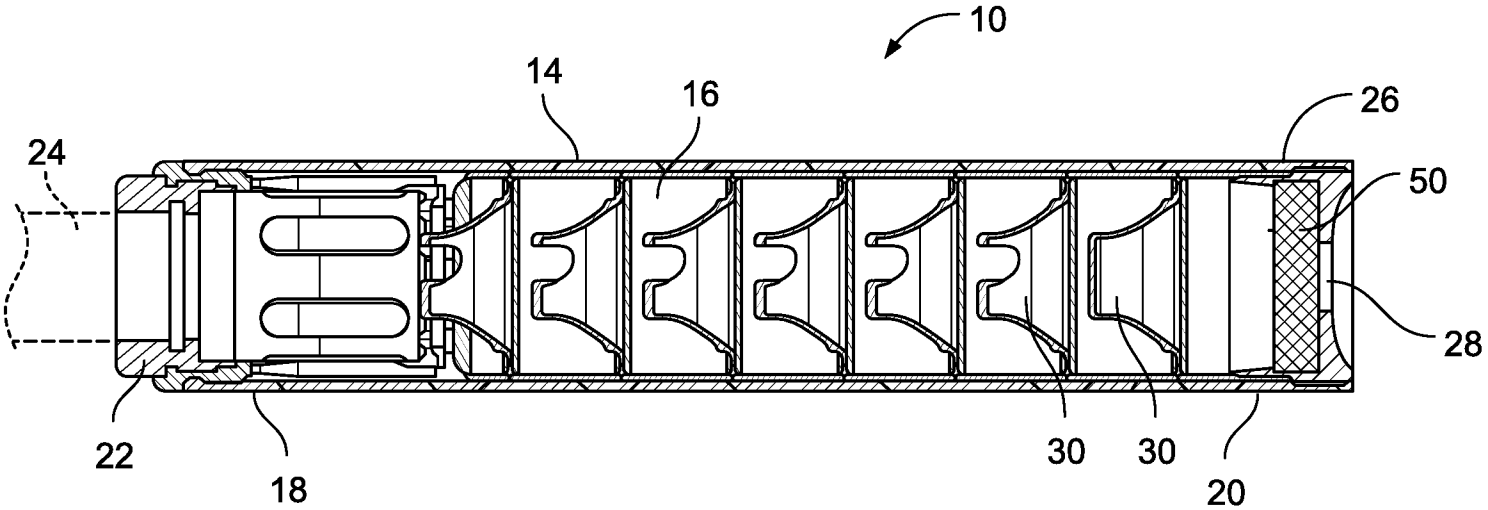
FIG. 2 is a longitudinal sectional view of an example embodiment of a sound suppressor according to at least one embodiment.

The present embodiments of the present disclosure will be best understood by reference to the drawings, wherein like parts are designated by like numerals throughout. It will be readily understood that the components of the disclosure, as generally described and illustrated in the figures herein, could be arranged and designed in a wide variety of different configurations. Thus, the following more detailed descriptions of the embodiments of the apparatus, as represented in FIGS. 3-7 and 10A-12H are not intended to limit the scope of the disclosure, as claimed, but are merely representative of present embodiments.

In general, the figures disclose a wiped muzzle device such as a brake, flash suppressor, or compensator that channels muzzle blast gases away from the distal end of a firearm. A wipe is configured to will improve the functionality of a compensator by increasing the amount of muzzle blast gases redirected through the compensator. A wipe is configured to improve the functionality of the flash suppressor by altering the mixing of gases which reduces recoil and also alters the mixing of the muzzle blast gases exiting the muzzle end of the bore.

In the following description, numerous references will be made to firearms, and muzzle accessories such as suppressors, compensators, brakes, flash compensators, as well as flash, bullets, projectiles and firearm structures, but these items are not shown in detail in the figures. However, it should be understood that one of ordinary skill in the art and in possession of this disclosure, would readily understand how the present disclosure and existing firearm structures and muzzle accessories can be incorporated.

Detailed references will now be made to the embodiments, examples of which are illustrated in FIGS. 3-7 and 10A-112H illustrate various views of a wiped muzzle device in accordance with one or more embodiments.

Some embodiments comprise a muzzle device. In some embodiments the muzzle device, such as is a compensator, brake or flash suppressor, comprises a body member with a bore passing through the body member. In some embodiments the body member is ovular, cylindrical, cuboidal or polygonal. In some embodiments the body member defines a bore formed in the primary axis of the body member. The body member is selectively coupleable to the muzzle end of a fire arm.

In some embodiments the body member comprises a plurality of vents formed through the side of the body member. In some embodiments the vents are configured to channel muzzle blast gases passing through the body member. In some embodiments the gases are mixed to improve the burn efficiency of the muzzle blast gases. In some embodiments the gases are channeled to direct the force vector of the gases to prevent muzzle rise or to offset recoil. In some embodiments the compensator comprises a receptacle within the body member and transverse the bore configured to receive a wipe. In some embodiments the receptacle is disposed distal the vents. In some embodiments the receptacle comprises a shoulder. In some embodiments the receptacle comprises a shoulder with a narrower cross-sectional area than the receptacle to allow a wipe to pass through the shoulder and be selectively held transverse the bore.

In some embodiments the compensator comprises a mounting cap affixed to the barrel mounting end of the body member which allows selective access to the receptacle. In some embodiments the mounting cap is adapted to receive the barrel of a firearm. In some embodiments the compensator comprises a muzzle cap affixed to the muzzle end of the body member wherein the muzzle cap defines an opening aligned with the barrel of a firearm to permit projectile egress. In some embodiments the compensator comprises a receptacle within the compensator wherein the plane of the receptacle transversely crosses the primary axis of the body member. In some embodiments the compensator comprises a wipe disposed in the receptacle.

In some embodiments the compensator comprises a tube defining a bore. In some embodiments the bore lies on the primary axis of the tube. In some embodiments the compensator comprises a plurality of vent holes extend through the tube wherein the tube has a barrel mounting end and a muzzle end.

In some embodiments the wipe material comprises a sheet of the wipe material which may be rolled or stored in other ways. In some embodiments the sheet is laid flat and the cutting tool is positioned against and then pressed through the substrate to cut a piece of the substrate in the shape of the cutting tool. In some embodiments the substrate is polyurethane, rubber, in other embodiments the wipe substrate is a corrugated fiber. In other embodiments the wipe substrate material is a composite of natural fibers and synthetic fibers engineered to allow penetration in the center but slow the degradation of the wipe to allow its use for a longer time. In some embodiments the wipe is a round shape. In some embodiments the wipe is a polygon. In some embodiments the cutting tool is in the shape of the baffles with which the cutting tool is going to cut.

In some embodiments the receptacle is positioned transversely the firing axis. In some embodiments the compensator is annular. In some embodiments the compensator is a polygon. In some embodiments the compensator is a muzzle accessory. In some embodiments the compensator is a component of a muzzle accessory. In some embodiments a cover is a component of a muzzle accessory. A compensator may be incorporated into a muzzle accessory or a component of a muzzle accessory, or into the barrel, stock, grip or other parts of the firearm.

In some embodiments the compensator comprises a wipe-receiving member. In some embodiments the wipe-receiving member comprises a shoulder that is proportionally smaller than the wipe-receiving member whereby the wipe may be pressed over the shoulder to settle and be retained in the wipe-receiving member. In some embodiments the wipe-receiving member is angled so as to narrow at the distal end of the compensator. In some embodiments the wipe-receiving member is substantially straight from the distal end of the compensator.

In some embodiments the cutting blade is configured to be manually pressed against the substrate so as to cut a portion of the substrate into the shape of a wipe. In some embodiments the skirt is shaped in a polygon. In some embodiments the skirt is shaped to cut the wipe in the shape of a suppressor baffle. In some embodiments the skirt is shaped to cut the wipe into the shape of the muzzle accessory. In some embodiments the wipe cut as an annular circular. In some embodiments the wipe is cut in the shape of an oval. In some embodiments the cutting tool is configured to cut the substrate in the field, thus allowing the shooter to replace consumed wipes without removing all muzzle accessories.

In some embodiments the distal edge, or the edge away from the plate, of the skirt comprises a cutting blade configured to cut a wipe from a substrate. In some embodiments the wipe is cut to a pre-determined size, such as the size of a receiving member positioned transversely to the firing axis.

Selection of wipe material is based on tradeoffs—thick wipes may provide improved durability, but reduce accuracy, while other materials interfere less with the bullet, but do not maintain a tight seal with passing bullets. Selecting the optimal wipe material also depends on bullet shapes and speeds. In some embodiments the wipes of differing materials can be selectively exchanged to achieve the desired affects based on the selected material. In some embodiments the wipe can be selectively exchanged based on the ammunition, such as overpressure loads, or bullet characteristics (Lead Round Nose, Wad Cutter, Semi Wad Cutter, Semi-Jacketed, Full Metal Jacket, Semi-Jacketed Hollow Point, Jacketed Hollow Point, Special, as well as others).

The wipe is secured in position in a receiving member formed in a muzzle device or a muzzle accessory. As used herein, a muzzle device or muzzle accessory may comprise a flash suppressor, a compensator, a muzzle brake, flash hider, wiped flash suppressor, wiped compensator, wiped muzzle brake or wiped flash hider. However, the term muzzle device or muzzle accessory does not include a sound suppressor as shown in FIGS. 1-2 and 8-9. A muzzle accessory component may comprise any member of a muzzle accessory including a baffle, a plate, a skirt a vent or a combination of components making up an accessory. In some embodiments the cutting tool is incorporated into the end of a barrel. In some embodiments, the wipe is used in connection with a flash suppressor by improving the mixture of gases escaping from the muzzle. In some embodiments the wipe improves the performance of the accessory, such as a compensator. In some embodiments the compensator redirects the mixture of gases created upwards when the bullet is fired to counter muzzle rise or muzzle flip. In some embodiments the muzzle accessory comprises a muzzle brake. Muzzle brakes direct the air to slow the burn of powder escaping from the muzzle. A wipe used in conjunction with a brake forces more of the gases through the vents, improving the functionality of the brake. In some embodiments the wipe, used in conjunction with a muzzle device or muzzle accessory improves the disbursement of the muzzle flash, changing the firearm's flash signature and increasing or concealing the shooter's possible position. In some embodiments the wipe in these (non-suppressor) applications restricts the amount of gas pressure able to exit forward (in line with the bore which is essentially wasted flow in terms of activating a braking/compensating effect) thus altering the mixing of gases in the sides or above instead which create the braking/compensating effect. Therefore increasing the effectiveness of the muzzle accessory, brake or compensator.

In some embodiments the wipe is configured to be manually placed in a receiving member. Wipe replacement is configured to be simple, without requiring additional tools or involve sending the muzzle accessory to the manufacturer or a factory. In some embodiments a single person can replace the wipe. In some embodiments the wipe can be replaced in the field. In some embodiments a user, such as a shooter, may take a weapon with a spent or consumed wipe disposed in a muzzle accessory, disassemble the muzzle accessory to expose the cutting tool and cut a new wipe from a substrate, such as a sheet of rubber approximately 2-5 mm thick. The substrate is placed next to the cutting blade and the cutting blade is pressed through the substrate the distance of the skirt. The cutting tool is a template for cutting wipes the correct dimension and the substrate is a predetermined thickness configured to fit within the receiving member. In some embodiments the receiving member is proximal the plate so that the wipe is pressed into the receiving member and the wipe is secured when the muzzle accessory is reassembled and attached to the muzzle.

In some embodiments the plate of the cutting tool is integrated into the body of the firearm. In some embodiments the plate is configured to be removed from the end of a muzzle accessory. In some embodiments the plate is configured to extend from the distal end of a muzzle accessory. In some embodiments the cutting blade comprises the distal end of the cutting tool. In some embodiments the cutting tool comprises a sound suppressor having a plurality of baffles wherein the shape of the skirt matches the shape of at least one of the baffles. In some embodiments the shape of the baffle is round. In some embodiments the shape of the baffle is a polygon. In some embodiments the end of the accessory is secured with a nut, which is selectively removed. In some embodiments the end of the accessory comprises a plate which may comprise a skirt with a cutting blade. In some embodiments the baffle shape progresses along the bore from a first shape at the proximal end to a second shape at the distal end, in which case the wipe is generally cut to match the baffle on the distal end closest to the firing end of the muzzle. In some embodiments the wipe is configured to be secured adjacent baffles at or near the proximal end. In some embodiments a receiver or receiving member comprises a shoulder configured to retain the wipe. In some embodiments the cutting tool is separate from a firearm, such as in the muzzle device or muzzle accessory. In some embodiments the muzzle tool is integrated into the body of the firearm. In some embodiments an end cap may be selectively removed to allow access to a baffle. In some embodiments the baffle may comprise a skirt and a cutting blade. In some embodiments the baffle is used as a cutting tool to cut the substrate.

In some embodiments the muzzle accessory is a muzzle device. In some embodiments the muzzle accessory includes a plate. In some embodiments the muzzle device comprises a skirt with a cutting blade. Some embodiments comprise a muzzle cap. In some embodiments the muzzle cap is configured to selectively couple to a barrel end of a tube. Tube as defined herein is not limited to circular or ovular cross-sectional shape, but also encompasses polygons as well as cross-sectional shapes comprising muzzle accessories as well as "tubeless" muzzle accessories such as the OMEGA 9K™, SALVO 12™, or MAXIM 9™ accessories. Tube may comprise the body member of the compensator through which vents are formed. In some embodiments the muzzle cap is configured to cover a cutting blade when the muzzle cap is selectively coupled to the end of a muzzle of a firearm. In some embodiments the muzzle cap further comprises a receiver configured to receive a wipe.

In some embodiments the muzzle accessory comprises a compensator. In some embodiments the muzzle accessory comprises a muzzle brake. In some embodiments the muzzle accessory comprises a suppressor configured to suppress sound. In some embodiments the muzzle accessory comprises a flash suppressor. In some embodiments the muzzle accessory has a cross-section that is a polygon.

Some embodiments comprise a method of preparing a wipe. In some embodiments include the steps of removing a muzzle cap from a muzzle end of a muzzle accessory to expose a cutting edge on the muzzle cap. Some embodiments may include forcing the cutting edge into a substrate. In some embodiments the substrate is material suitable for a firearm wipe. In some embodiments the cutting edge separates the wipe from the substrate. Some embodiments may include placing the wipe within the muzzle accessory adjacent to the muzzle cap. Some embodiments may include replacing the muzzle cap on the muzzle end of the muzzle accessory.

Referring to FIG. 1, an embodiment concerns a suppressor 10 for a firearm 12. In an example embodiment shown in FIG. 2, the suppressor 10 comprises a tube 14 defining a bore 16. The tube 14 has a barrel mounting end 18 and a muzzle end 20. A mounting cap 22 is affixed to the barrel mounting end 18 of the tube 14. The mounting cap 22 is adapted to receive a barrel 24 of the firearm 12 (see also FIG. 1) and may take one of many forms and cross-sectional shapes. Example mounting caps include simple threaded fittings which engage threads on the barrel, a piston mount (aka booster, nielsen device, L.I.D), bayonet-type fittings, as well as quick disconnect fittings as disclosed in U.S. Pat. Nos. 8,555,765; 8,714,301 and 8,950,546, all of which are hereby incorporated by reference herein. Some embodiments utilize mountings more common for handguns, where a threaded body that moves inside of the suppressor is attached to the firearm barrel, but is not the cap itself, rather it is retained from sliding out of the suppressor by a separate threaded cap with a hole allowing it to reciprocate through. In some embodiments, this portion threaded to the barrel has a section inside with a diameter shoulder larger than the retaining cap which allows a spring to return it into position and keeps it from coming out of the suppressor. A muzzle cap 26 is affixed to the muzzle end 20 of the tube 14. The muzzle cap 26 defines an opening 28 aligned with the barrel 24 of the firearm 12 to permit egress of a projectile. A plurality of baffles 30 are positioned within the bore 16 between the mounting cap 22 and the muzzle cap 26.

Figure 3:
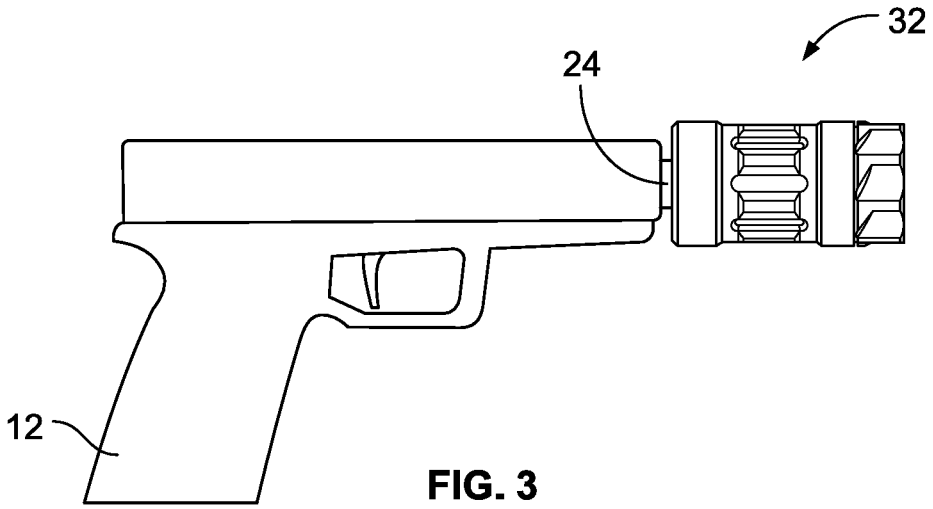
FIG. 3 is a side view of a firearm having an example wiped muzzle device such as a compensator, flash suppressor or brake according to at least one embodiment.
Figure 4:
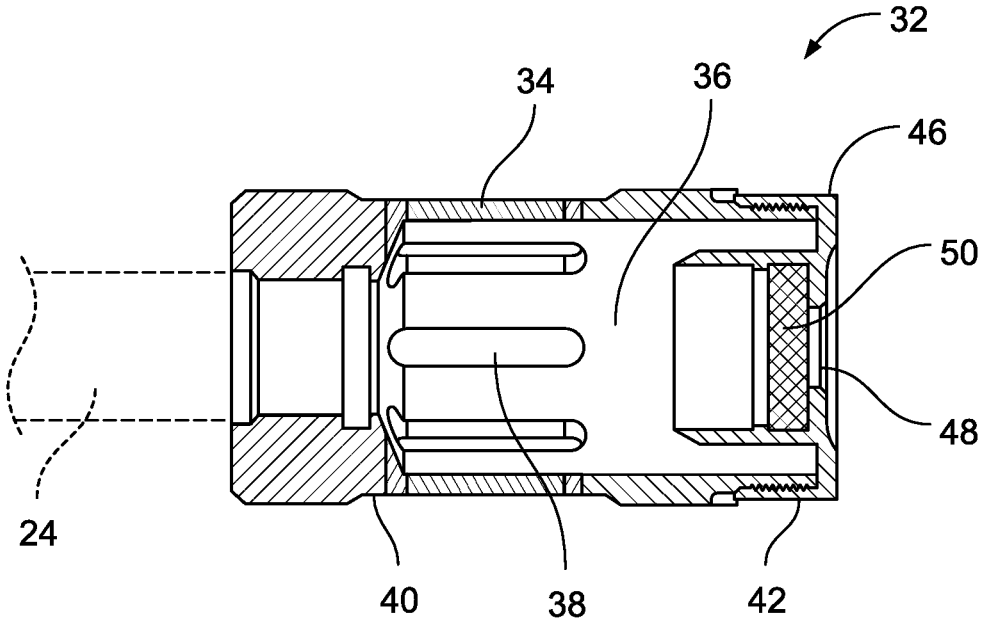
FIG. 4 is a longitudinal sectional view of an example embodiment of a wiped muzzle device according to at least one embodiment.

As shown in FIG. 3, at least one embodiment also encompasses a wiped compensator 32 for firearm 12. FIG. 4 shows the wiped compensator example embodiment 32, which comprises a tube 34 defining a bore 36. A plurality of vent holes 38 extend through the tube 34. Tube 34 has a barrel mounting end 40 and a muzzle end 42. A muzzle cap 46 is affixed to the muzzle end 42 of the tube 34. The muzzle cap 46 defines an opening 48 aligned with the barrel 24 of the firearm 12 to permit projectile egress.

As shown in FIG. 4, so called "wipes" 50 are positioned muzzle accessories including muzzle brakes, flash suppressors, and the wiped compensator 32. While a wipe may be positioned anywhere along the firing axis, as shown in FIG. 4, a wipe 50 is positioned within the distal end of the muzzle accessory or adjacent to the muzzle cap 26. In some embodiments the assembly housing the wipe 50 is configured to be selectively disassembled, embodiments of which are described in more detail below. A wipe 50 is similarly positioned within the distal end of the compensator tube 34 adjacent to the muzzle cap 46. Wipes are elements which further reduce the acoustic intensity of the firearm's report due to high velocity gases behind the projectile escaping the muzzle. High speed photographs of wipe equipped compensators further show that the presence of a wipe in a compensator causes a greater portion of muzzle blast gases to be diverted through the vent holes 38 as opposed to escaping through the opening 48 in the muzzle cap 46, thereby also improving the effectiveness of the compensator 32.

Wipes are cut from a substrate of soft, pliant damping material such as, but not limited to polypropylene, neoprene, polyurethane and rubber. Wipe material is selected for its ability to permit a projectile to pass through without significant resistance while forming a seal around the projectile to inhibit the escape of propellant gases, thereby further dissipating acoustic energy and decreasing felt recoil. Wipes deteriorate with each round fired and are thus a consumable item which must be replaced after a finite number of rounds have passed through. It is thus advantageous to provide a cutting blade mounted to the muzzle accessory, such as on one of the suppressor tube, the compensator tube, or the muzzle cap of a suppressor or a compensator. Having a cutting blade as part of the suppressor or compensator allows wipes of the proper dimensions to be readily formed.

Figure 5:
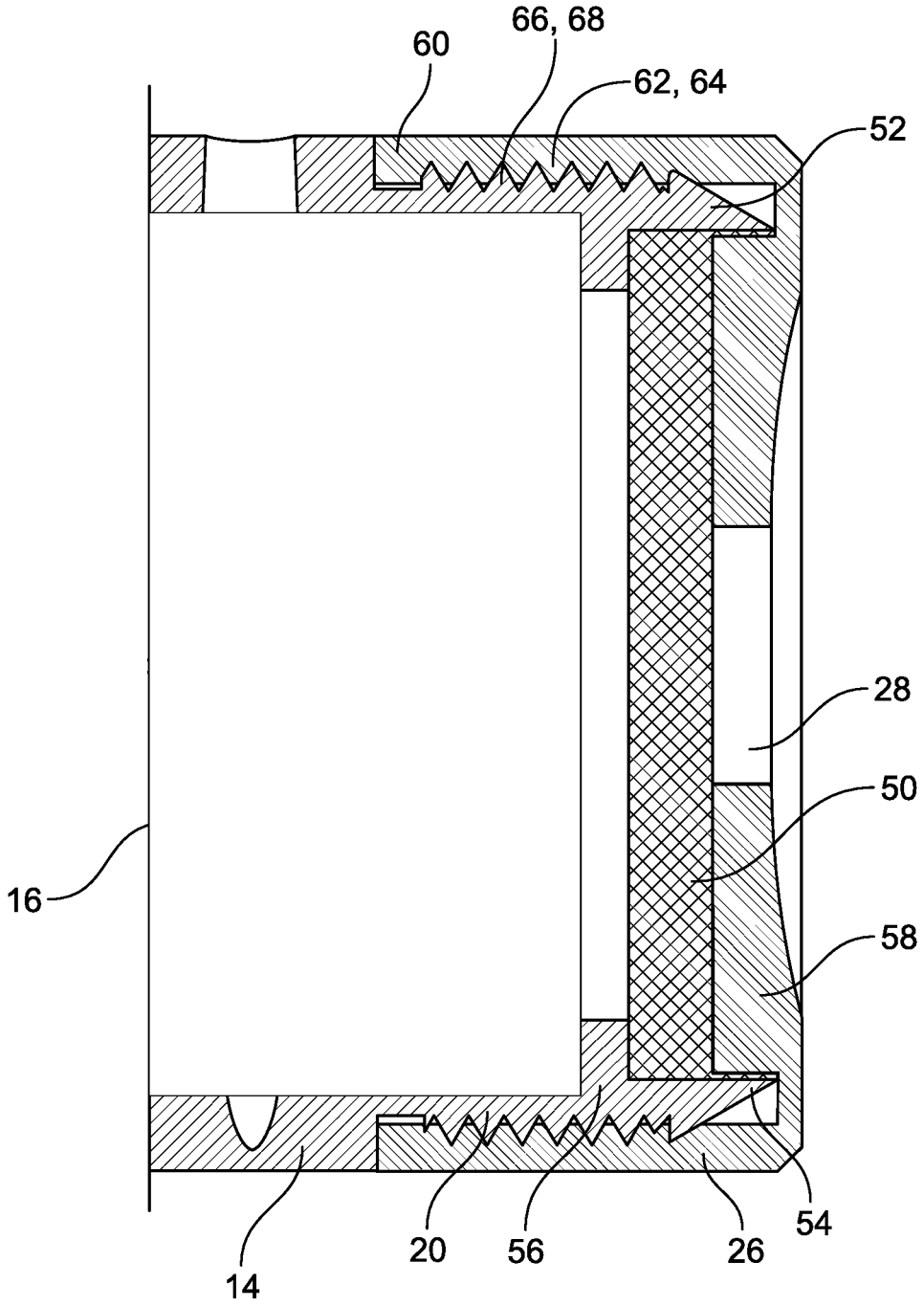
FIG. 5 is a longitudinal sectional view of a portion of an example wiped muzzle device according to at least one embodiment.

FIG. 5 shows an example embodiment wherein a cutting blade 52 is mounted on the muzzle end 20 of a suppressor tube 14. In this example the cutting blade 52 is integrally formed with the tube 14 and comprises a sharpened circumferential edge 54 of the muzzle end of the tube. A shoulder 56 extends circumferentially around the suppressor tube 14 within the bore 16. The shoulder is positioned proximate to the muzzle end 20 of the tube 14 and may be integrally formed to the tube 14. The muzzle cap 26 in this example comprises a plate 58 oriented transversely to the bore 16. Plate 58 defines the muzzle cap opening 28. A skirt 60 surrounds the plate and extends transversely thereto. Attachment of the muzzle cap 26 to tube 14 is effected by a plurality of female screw threads 62 positioned on an inner surface 64 of skirt 60 facing the bore 16. A plurality of male screw threads 66 are positioned on an outer surface 68 of tube 14 at the muzzle end 20. The male screw threads 66 are compatible with the female screw threads 62 for securing the muzzle cap 26 to the tube 14. Wipe 50, cut from a substrate using cutting blade 52, may be positioned within the bore 16, the wipe being captured between the shoulder 56 and the muzzle cap 26. In some embodiments the cutting blade 52 comprises a leading edge of the muzzle accessory to as to conveniently interface with and cut the substrate without the interference other members of the muzzle accessory. Although described and shown for a suppressor, it is understood that the cutting blade 52 comprising a sharpened circumferential edge of a tube, the shoulder 56 and the male screw threads 66 may also be used on the tube 34 of the wiped compensator 32 shown in FIG. 3. Such a compensator will also have the compatible female threads on its muzzle cap 46.

Figure 6:
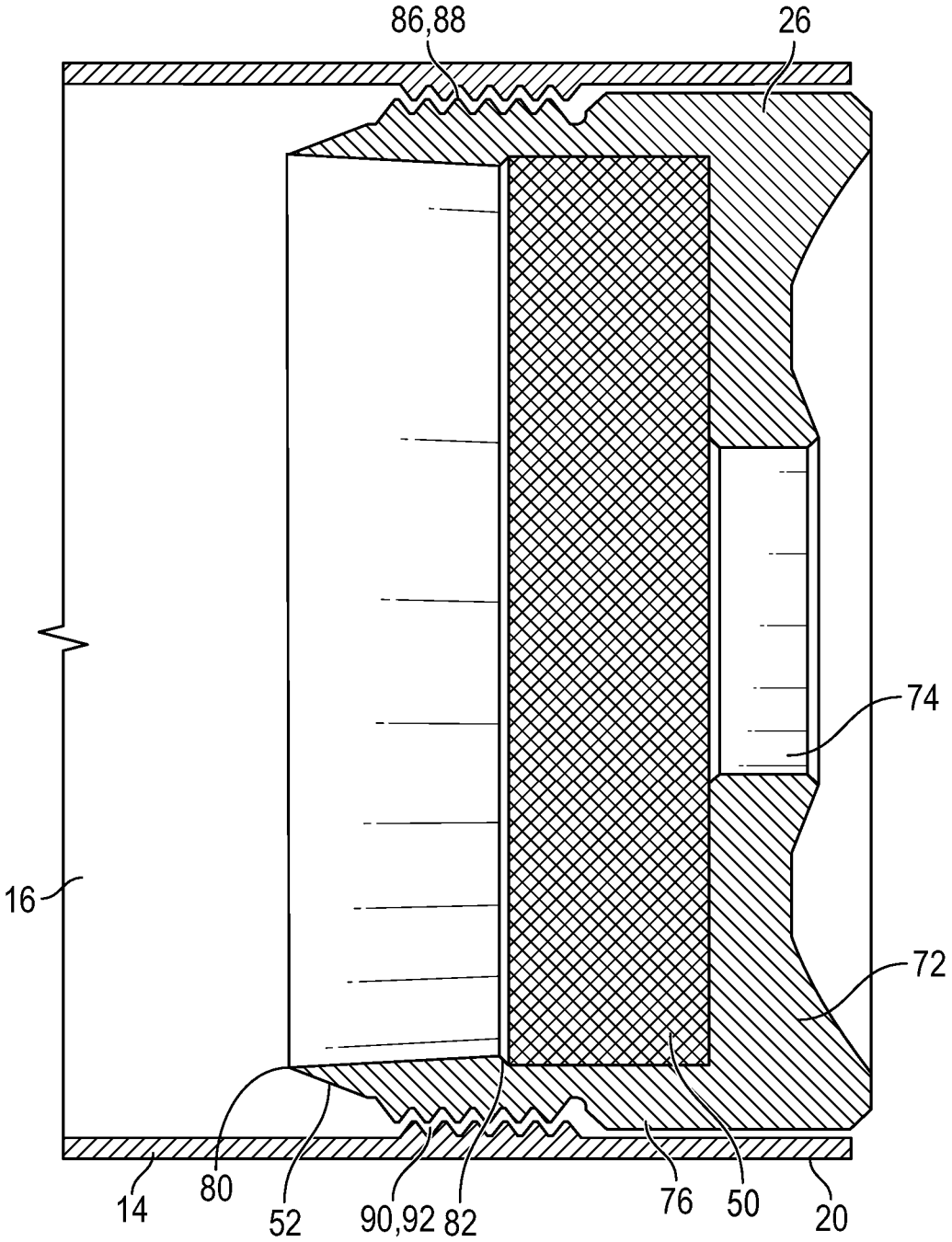
FIG. 6 is a longitudinal sectional view of a portion of an example wiped muzzle device according to at least one embodiment.

FIG. 6 shows an example muzzle cap 26 according to at least one embodiment which may be used on a muzzle device such as shown in the wiped compensator 32 of FIG. 4, the compensator being illustrated by way of example. In the example muzzle cap 26 the cutting blade 52 is mounted on the muzzle cap. Muzzle cap 26 comprises a plate 72 oriented transversely to the bore of the suppressor or compensator tube. Plate 72 defines the opening 74 permitting projectile egress. A skirt 76 surrounds the plate 72 and extends transversely to it. The cutting blade 52 comprises a sharpened circumferential edge 80 of the skirt 76. Cutting blade 52 is thus integrally formed with the muzzle cap 26 to form the leading edge of the muzzle cap. Muzzle cap 26 further comprises a shoulder 82 extending circumferentially around an inner surface 84 of the skirt 76. In this example the shoulder 82 is also integrally formed with the muzzle cap 26 by a machined undercut positioned in spaced relation to the plate 72. A wipe 50 may be positioned within the muzzle cap 26 between the shoulder 82 and the plate 72 as shown in FIG. 6. Attachment of the muzzle cap 26 to the suppressor tube or the compensator tube is via a plurality of male screw threads 86 positioned on an outer surface 88 of the skirt 76 facing away from the tube bore 16. As shown in FIG. 6, a plurality of female screw threads 90, positioned on an inner surface 92 of the suppressor tube 14 at its muzzle end 20, are compatible with the male screw threads 86 for securing the muzzle cap 26 to the tube 14.

Figure 7:
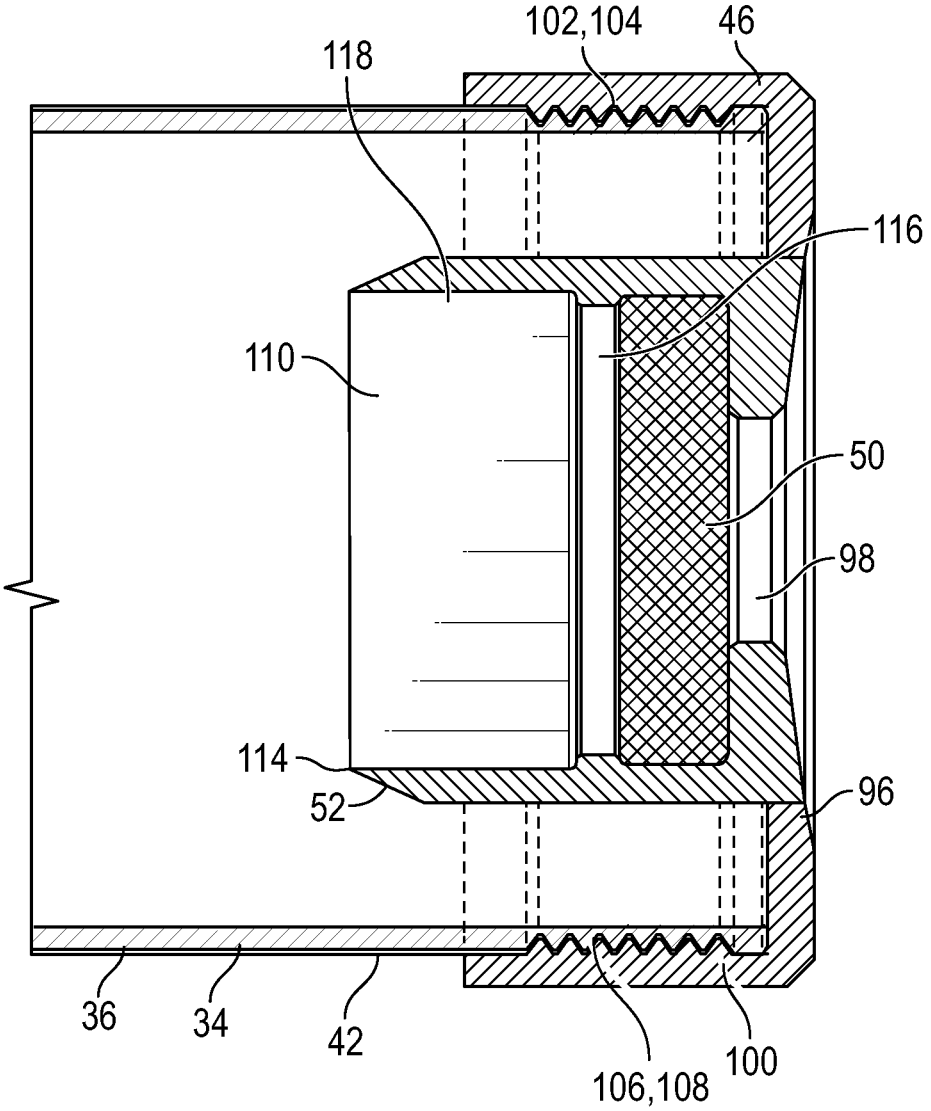
FIG. 7 is a longitudinal sectional view of a portion of an example wiped muzzle device according to at least one embodiment.
Figure 8:
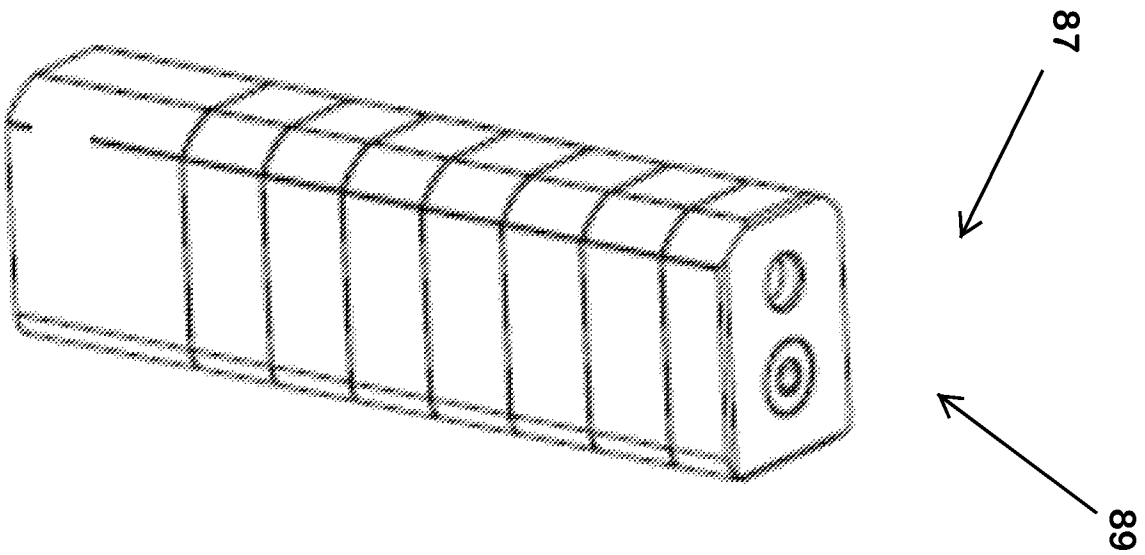
FIG. 8 is a perspective view of a sound suppressor according to at least one embodiment.
Figure 9:
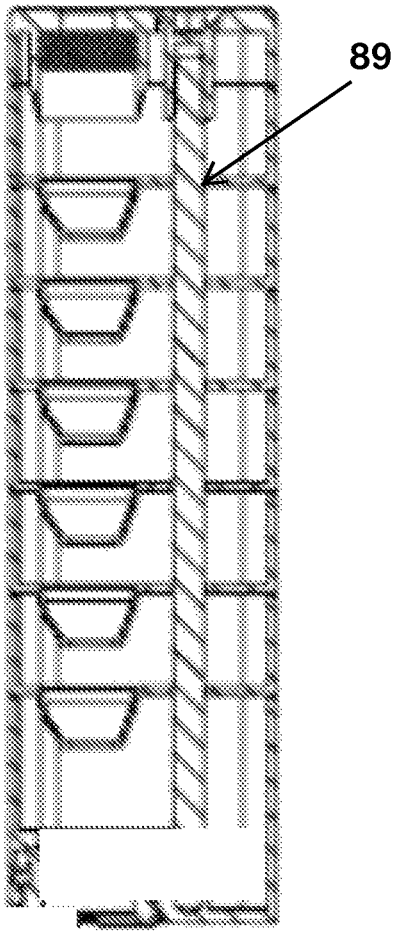
FIG. 9 is a longitudinal sectional view of a sound suppressor according to at least one embodiment.
Figures 10A, 10B, 10C, 10D, 10E, 10F, 10G:
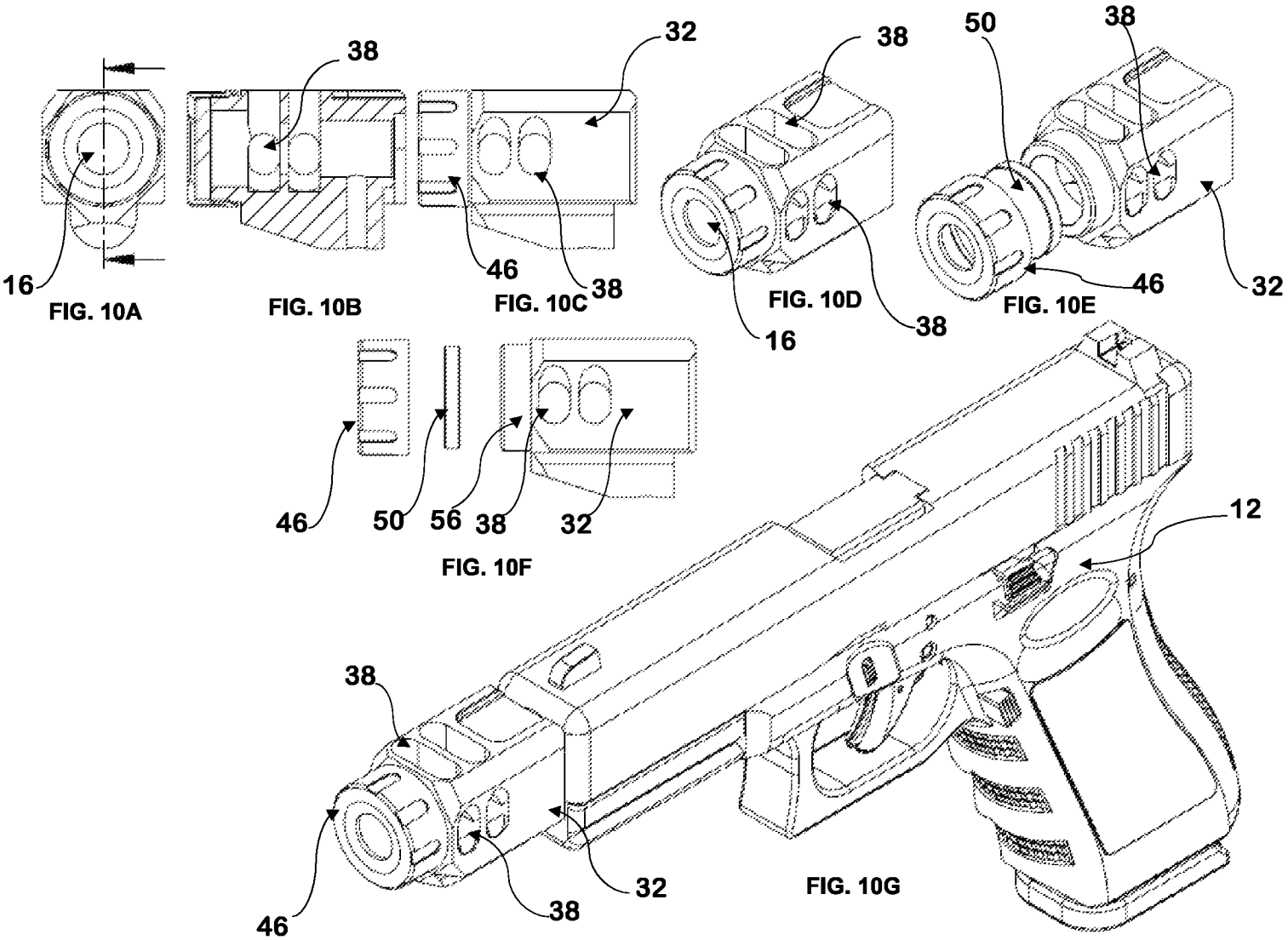
FIG. 10A is a lateral sectional view of a wiped muzzle device according to at least one embodiment.
FIG. 10B is a longitudinal sectional view of a wiped muzzle device according to at least one embodiment.
FIG. 10C is a side view of a wiped muzzle device according to at least one embodiment.
FIG. 10D is a perspective view of a wiped muzzle device according to at least one embodiment.
FIG. 10E is an expanded perspective view of a wiped muzzle device according to at least one embodiment.
FIG. 10F is an expanded side view of a wiped muzzle device according to at least one embodiment.
FIG. 10G is a perspective view of a wiped muzzle device coupled to an example firearm according to at least one embodiment.
Figure 11B:
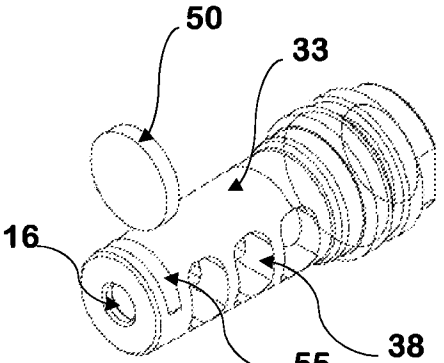
FIG. 11B is another perspective view of a brake according to at least one embodiment.
Figure 11A:
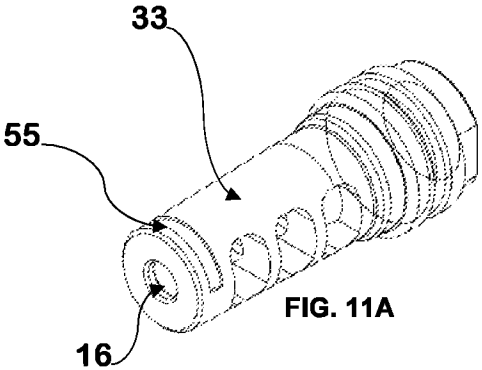
FIG. 11A is a perspective view of a brake, illustrating a slot for receiving a wipe according to at least one embodiment.
Figure 11C:
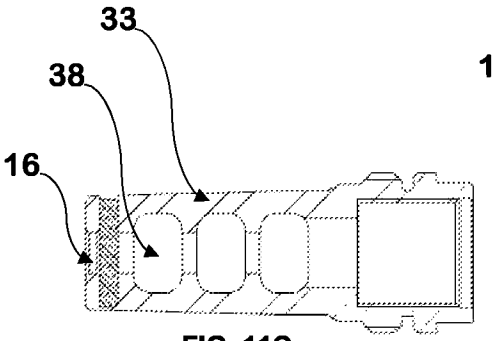
FIG. 11C is a longitudinal sectional view of a brake according to at least one embodiment.
Figure 11E:
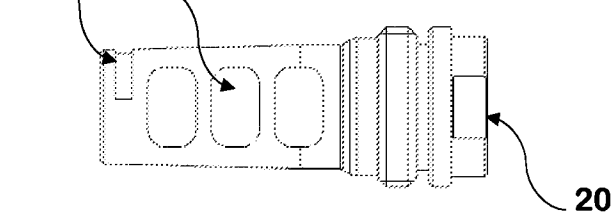
FIG. 11E is a side view of a brake according to at least one embodiment.
Figure 11D:
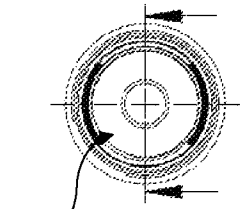
FIG. 11D is a lateral sectional view of a brake according to at least one embodiment.
Figure 11H:
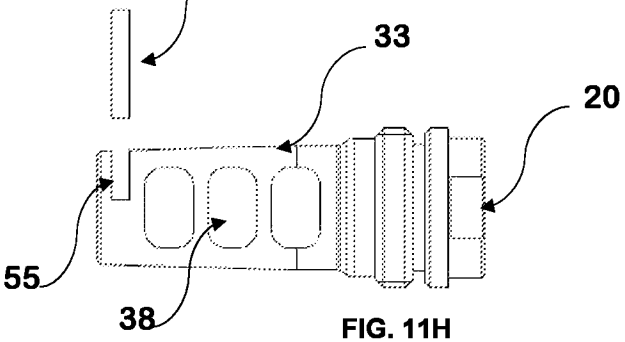
FIG. 11H is a side view of a brake and a wipe according to at least one embodiment.
Figure 11G:
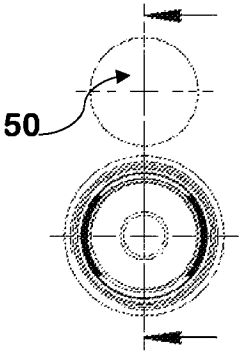
FIG. 11G is a lateral sectional view of a brake and a wipe according to at least one embodiment.
Figure 11F:
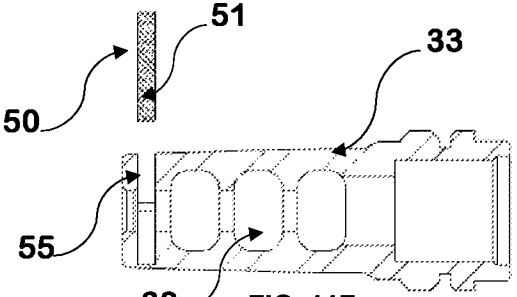
FIG. 11F is a longitudinal sectional view of a brake and a wipe according to at least one embodiment.
Figures 12A, 12B, 12C, 12D, 12E, 12F, 12G, 12H:
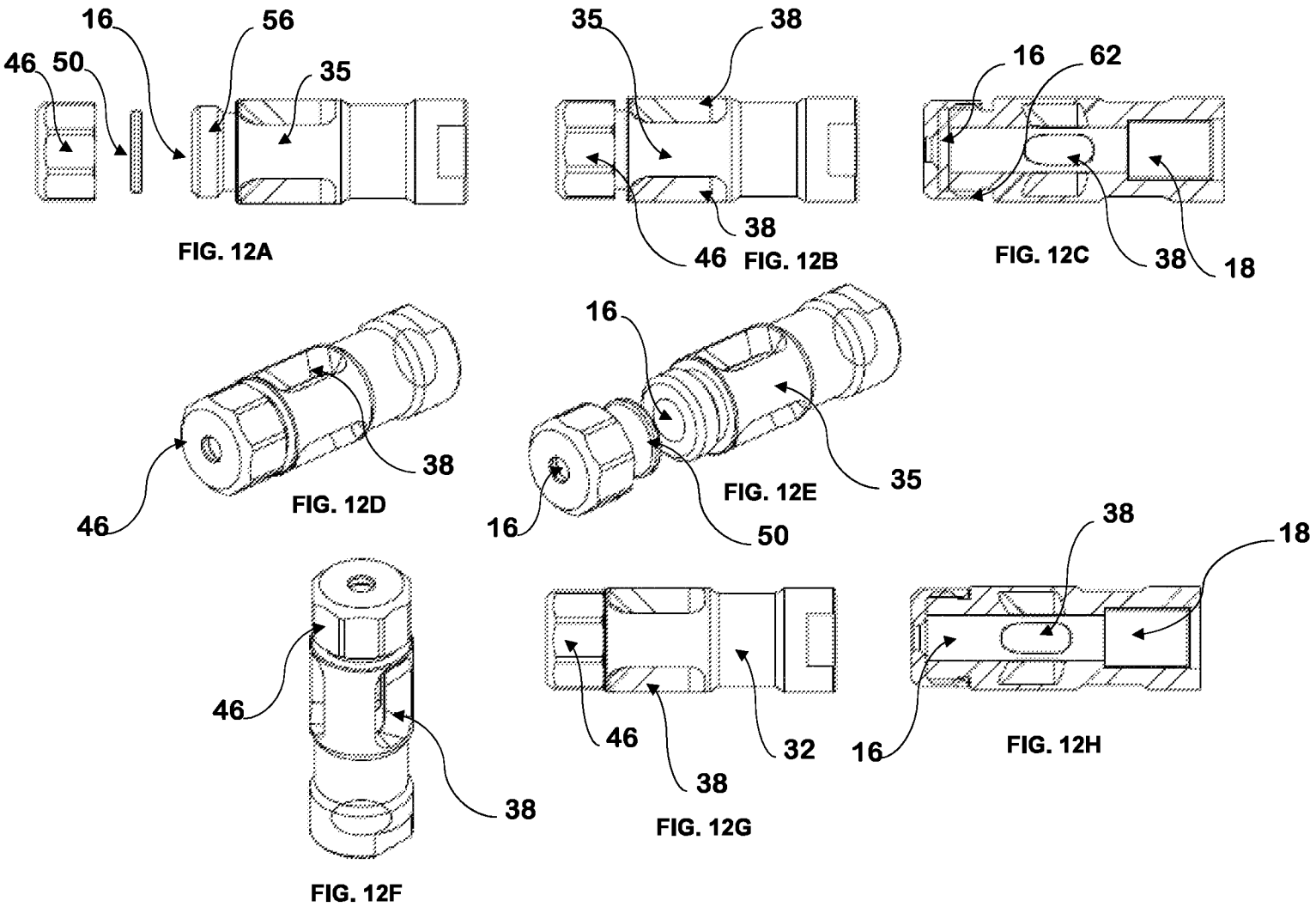
FIG. 12A is an expanded side view of a flash hider, according to some embodiments.
FIG. 12B is a side view of a flash hider, according to some embodiments.
FIG. 12C is a longitudinal sectional view of a flash hider, according to some embodiments.
FIG. 12D is a perspective view of a flash hider, according to some embodiments.
FIG. 12E is an expanded perspective view of a flash hider, according to some embodiments.
FIG. 12F is another perspective view of a flash hider, according to some embodiments.
FIG. 12G is another side view of a flash hider, according to some embodiments.
FIG. 12H is a longitudinal sectional view of a flash hider, according to some embodiments.

FIG. 7 shows the example muzzle cap 46 which may be used on both the muzzle device such as the wiped compensator 32 shown in FIG. 4, the compensator being illustrated by way of example. Muzzle cap 46 comprises a plate 96 oriented transversely to the bore 36 of the compensator tube 34. Plate 96 defines the projectile egress opening 98. A first skirt 100 surrounds the plate 96 and extends transversely to it. The first skirt 100 engages the muzzle end 42 of the compensator tube 34 for attaching the muzzle cap 46 to it. Attachment may be effected via a plurality of female screw threads 102 positioned on an inner surface 104 of the first skirt 100 facing toward the compensator bore 36. A plurality of male screw threads 106 are positioned on an outer surface 108 of the compensator tube 34 at its muzzle end 42. The male and female screw threads are compatible for securing the muzzle cap 46 to the compensator tube 34. In an alternate embodiment the arrangement of the threads may be reversed and a plurality of male screw threads may be positioned on an outer surface of the first skirt facing away from the bore and a plurality of female screw threads may be positioned on an inner surface of the tube at the muzzle end thereof.

Example muzzle cap 46 further comprises a second skirt 110 extending transversely to the plate 96. Second skirt 110 surrounds the opening 98 and is positioned within a perimeter of the first skirt 100. The cutting blade 52 in this example comprises a sharpened circumferential edge 114 of the second skirt 110. A shoulder 116 extends circumferentially around an inner surface 118 of the second skirt 110 in spaced relation to the plate 96. As shown in FIG. 7, a wipe 50 may be positioned within the second skirt 110, the wipe being captured between the shoulder 116 and the plate 96.

The suppressor and compensator tubes 14 and 34 are shown by way of example as having round cross sectional shapes, but it is understood that cross sectional shapes other than round are also feasible. Likewise, the various skirts 60, 76, 100 and 110 are depicted as having round cross sectional shapes, although other shapes are considered as well.

The disclosure comprises muzzle accessories in a variety of shapes, such as that shown in FIGS. 8-12H. In some embodiments the cross-sectional area of the muzzle accessory is a polygon. In some embodiments the muzzle cap or end cap 87 is secured in place by tie-rod 89. In this embodiment the skirt may extend in the shape of end cap 87. In some embodiments the skirt may comprise the shape of the baffle, tube or other structure disposed within the muzzle accessory.

Referring now to FIGS. 10A-10G, in some embodiments the wipe-receiving member comprises a receptacle formed between the muzzle cap 46 and the muzzle end of the compensator 32. In some embodiments the muzzle cap 46 threads onto the muzzle end of the compensator 32. In some embodiments the receptacle comprises a shoulder 56 wherein the wipe 50 is compressed as it passes over the annular shoulder and expands once it passes over the shoulder and is disposed in the receptacle.

Referring now to FIGS. 11A-11H, in some embodiments the wipe-receiving member comprises a receiving slot 55 into which a wipe may be inserted. In some embodiments the slot 55 is formed in the distal end of the muzzle device. In some embodiments, the muzzle device may be a brake 33. In some embodiments the slot 55 is configured to receive a wipe in a position so that muzzle blast gases are forced through structures, such as vents 38 formed in the sidewall of the brake 33. In some embodiments the vents 38 are formed on adjacent sidewalls. In some embodiments the vents 38 are semi-circumscribe the brake 33. In some embodiments vents 38 comprise small conical openings in the compensator sidewall. In some embodiments vents 38 comprise channels of non-linear tubes formed in the compensator sidewall. In some embodiments the slot 55 forms an additional vent by allowing muzzle blast gases to escape around the edge of the wipe through the sidewall of the muzzle device. In some embodiments the slot 55 comprises a vent 38 integrated into the slot 55 so that the proximal end of the vent 38 faces the wipe 50.

In some embodiments the slot 55 is configured to be slightly narrower than the wipe 50 so as to create a seal between the wipe 50 and the slot 55 walls. In some embodiments a tighter fit between the slot 55 and the wipe 50 improve the functionality of the vents 38, to improve the redirection of the muzzle blast through vents 38.

In some embodiments wipe 50 comprises a textured edge 51 to increase the friction between the wipe 50 and the finger or tool used to remove the wipe 50. In some embodiments a rotational force is applied to the edge of the wipe 50 to rotationally pull the wipe 50 from the slot 55. In some embodiments this force is applied to a spent or consumed wipe 50. In other embodiments a rotational force is applied to a whole wipe 50 before a bullet has passed through the wipe, to allow the user to selectively change the type of wipe 50 used in the compensator based on the properties of the material or materials used to make the wipe 50.

Referring now to FIGS. 12A-12G, in some embodiments the wipe-receiving member comprises a receptacle formed between the muzzle cap 46 and the muzzle end of a flash hider 35. In some embodiments the muzzle cap 46 threads onto the muzzle end of the flash hider 35. In some embodiments the flash hider 35 comprises a shoulder 56 wherein the wipe 50 is compressed as it passes over the annular shoulder and expands once it passes over the shoulder and is disposed in the receptacle of the flash hider 35.

The disclosure also includes methods of preparing a wipe for use in a firearm suppressor or a wiped compensator. In one example embodiment, the method comprises: removing a muzzle cap from a muzzle end of the suppressor or the wiped compensator to expose a cutting edge on the muzzle cap; forcing the cutting edge into a substrate comprising material suitable for a firearm wipe, the cutting edge separating the wipe from the substrate.

The method may further comprise placing the wipe within the suppressor or the wiped compensator adjacent to the muzzle cap. In some embodiments the wipe is fully seated within muzzle cap.

The method may further comprise replacing the muzzle cap on the muzzle end of the suppressor or the wiped compensator.

Another example method of preparing a wipe for use in a firearm suppressor or a wiped compensator comprises: removing a muzzle cap from a muzzle end of the suppressor or the wiped compensator to expose a cutting edge on the suppressor or the wiped compensator; forcing the cutting edge into a substrate comprising material suitable for a firearm wipe, the cutting edge separating the wipe from the substrate.

The method may further comprise placing the wipe within the suppressor or the wiped compensator adjacent to the muzzle cap.

The method may further comprise replacing the muzzle cap on the muzzle end of the suppressor or the wiped compensator.

Figure 13:
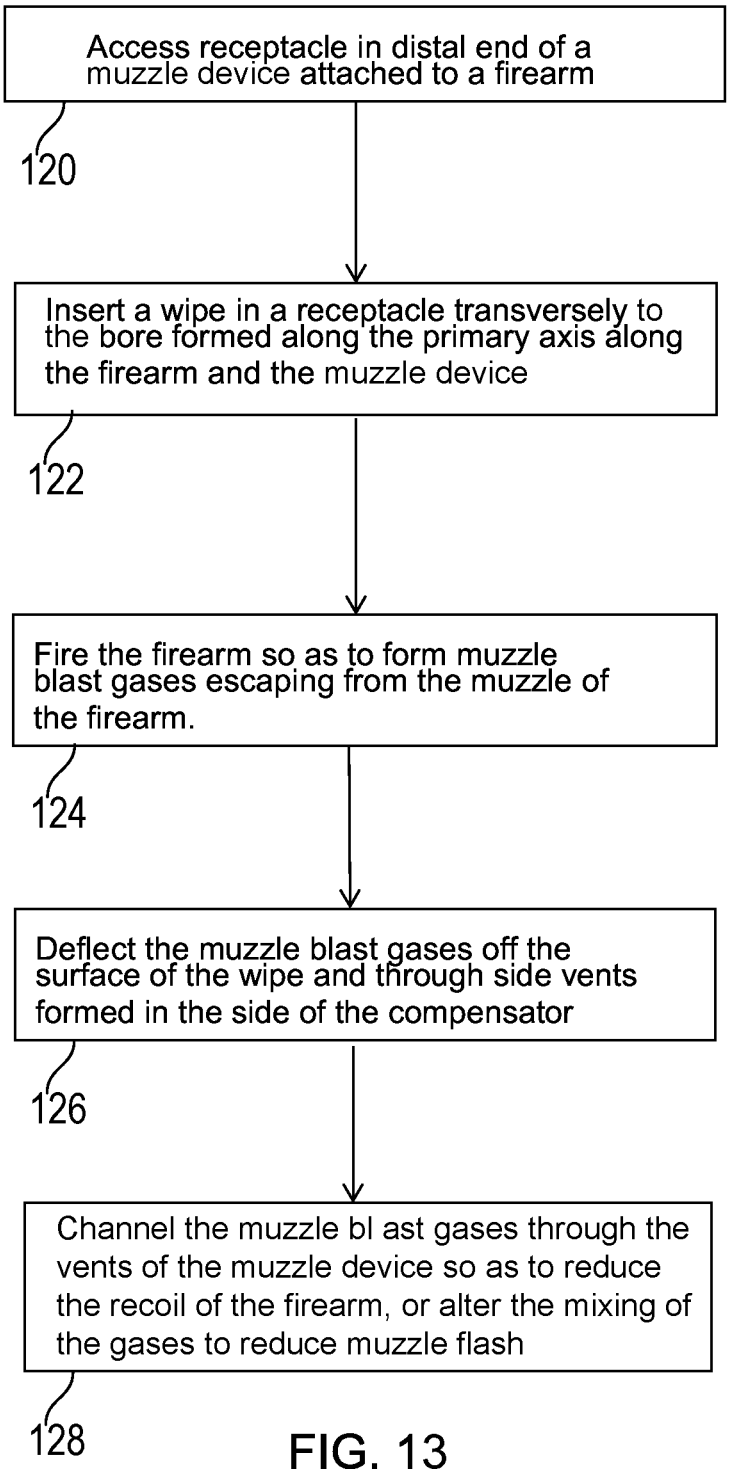
FIG. 13 is a flow chart illustrating an example method for channeling muzzle blast gas according to at least one embodiment.

The disclosure also includes methods of channeling the muzzle blast gases through the vents of a muzzle device so as to reduce the recoil of the firearm or alter the mixing of the gases to reduce muzzle flash. Illustrated in a flow chart in FIG. 13, in at least one example embodiment, the method comprises: first, at step 120, access the receptacle in the distal end of a muzzle device attached to a firearm. Second, at step 122, insert a wipe 50 in a receptacle transversely to a bore formed along the primary axis along the firearm and the muzzle device. Third, at step 124, fire the firearm so as to form muzzle blast gases escaping from the muzzle of the firearm. Fourth, at step 126, deflect the muzzle blast gases off the surface of the wipe and through side vents formed in the side of the muzzle device. Fifth, at step 128, channel the muzzle blast gases through the vents of the muzzle device so as to reduce the recoil of the firearm, or alter the mixing of the gases to reduce muzzle flash.

Figure 14:
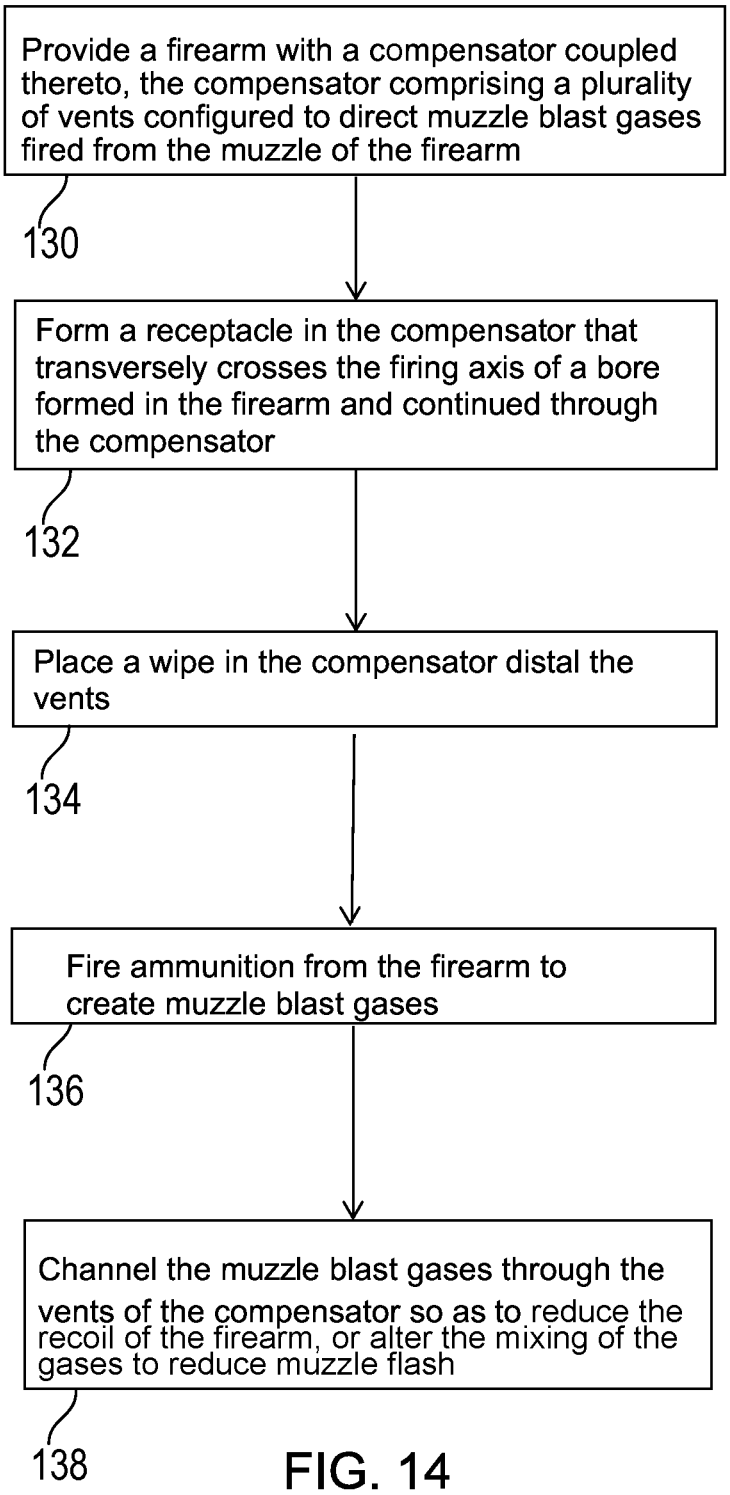
FIG. 14 is another flow chart illustrating an example method for channeling muzzle blast gas according to at least one embodiment.

In reference to the flowchart of FIG. 14, the disclosure also includes a method of channeling the muzzle blast gases through the vents of a compensator so as to reduce the recoil of the firearm or alter the mixing of the gases to reduce muzzle flash. In at least one example embodiment, the method comprises: first, at step 130, provide a firearm with a compensator coupled thereto, the compensator comprising a plurality of vents configured to direct muzzle blast gases fired from the muzzle of the firearm. Second, at step 132, form a receptacle in the compensator that transversely crosses the firing axis of a bore formed in the firearm and continued through the compensator. Third, at step 134, place a wipe in the compensator distal the vents. Fourth, at step 136, fire ammunition from the firearm to create muzzle blast gases. Fifth, at step 138, channel the muzzle blast gases through the vents of the compensator so as to reduce the recoil of the firearm, or alter the mixing of the gases to reduce muzzle flash.

A suppressor for a firearm, said suppressor comprising: a tube defining a bore, said tube having a barrel mounting end and a muzzle end; a mounting cap affixed to said barrel mounting end of said tube, said mounting cap adapted to receive a barrel of said firearm; a muzzle cap affixed to said muzzle end of said tube, said muzzle cap defining an opening aligned with said barrel of said firearm; a plurality of baffles positioned within said bore between said mounting cap and said muzzle cap; and a cutting blade mounted on one of said tube or said muzzle cap. In some embodiments the cutting blade is mounted on said muzzle end of said tube. In some embodiments the cutting blade is integrally formed with said tube. In some embodiments the cutting blade comprises a sharpened circumferential edge of said muzzle end of said tube. Some embodiments a suppressor wherein the muzzle cap comprises a plate oriented transversely to said bore, said plate defining said opening, a skirt surrounding said plate and extending transversely thereto; a plurality of female screw threads are positioned on an inner surface of said skirt facing said bore; a plurality of male screw threads are positioned on an outer surface of said tube at said muzzle end thereof, said male screw threads being compatible with said female screw threads for securing said muzzle cap to said tube.

In some embodiments the suppressor comprises a shoulder extending circumferentially around said tube within said bore, said shoulder being positioned proximate to said muzzle end of said tube. In some embodiments the suppressor comprises a wipe positioned within said bore, said wipe being captured between said shoulder and said muzzle cap. In some embodiments the cutting blade is mounted on said muzzle cap. In some embodiments the cutting blade is integrally formed with said muzzle cap. Some embodiments comprise the suppressor wherein said muzzle cap comprises a plate oriented transversely to said bore, said plate defining said opening; a skirt surrounds said plate and extends transversely thereto; and said cutting blade comprises a sharpened circumferential edge of said skirt. In some embodiments the suppressor further comprises a plurality of male screw threads positioned on an outer surface of said skirt facing away from said bore; a plurality of female screw threads positioned on an inner surface of said tube at said muzzle end thereof, said female screw threads being compatible with said male screw threads for securing said muzzle cap to said tube.

In some embodiments the suppressor further comprises a shoulder extending circumferentially around an inner surface of said skirt in spaced relation to said plate. In some embodiments the suppressor further comprises a wipe positioned within said muzzle cap, said wipe being between said shoulder and said plate. Some embodiments comprise the suppressor wherein: said muzzle cap comprises a plate oriented transversely to said bore, said plate defining said opening; a first skirt surrounds said plate and extends transversely thereto, said first skirt engaging said muzzle end of said tube for attaching said muzzle cap thereto; a second skirt extends transversely to said plate and surrounds said opening, said second skirt being positioned within a perimeter of said first skirt; and said cutting blade comprises a sharpened circumferential edge of said second skirt.

In some embodiments the suppressor further comprises a shoulder extending circumferentially around an inner surface of said second skirt in spaced relation to said plate. In some embodiments the suppressor further comprises a wipe positioned within said second skirt, said wipe being captured between said shoulder and said plate. Some embodiments comprise a suppressor, wherein: a plurality of male screw threads are positioned on an outer surface of said first skirt facing away from said bore; a plurality of female screw threads are positioned on an inner surface of said tube at said muzzle end thereof, said female screw threads being compatible with said male screw threads for securing said muzzle cap to said tube. Some embodiments comprise a suppressor, wherein: a plurality of female screw threads are positioned on an inner surface of said first skirt facing toward said bore; a plurality of male screw threads are positioned on an outer surface of said tube at said muzzle end thereof, said female screw threads being compatible with said male screw threads for securing said muzzle cap to said tube. Some embodiments comprise a suppressor, wherein the tube has a round cross sectional shape. Some embodiments comprise a suppressor, wherein the skirt has a round cross sectional shape. Some embodiments comprise a suppressor, wherein: said first and second skirts have round cross sectional shapes.

Some embodiments comprise a muzzle cap for a component of a firearm, said muzzle cap comprising: a plate defining an opening; a skirt surrounding said plate and extending transversely thereto; a cutting blade comprising a sharpened circumferential edge of said skirt. In some embodiments the muzzle cap further comprises a plurality of male screw threads positioned on an outer surface of said skirt. In some embodiments the muzzle cap further comprises a shoulder extending circumferentially around an inner surface of said skirt in spaced relation to said plate. In some embodiments the muzzle cap further comprises a wipe positioned within said muzzle cap between said shoulder and said plate. In some embodiments the muzzle cap comprise a skirt wherein said skirt has a round cross sectional shape.

In some embodiments comprise a muzzle cap for a component of a firearm comprising: a plate defining an opening; a first skirt surrounding said plate and extending transversely thereto; a second skirt extending transversely to said plate, said second skirt surrounding said opening and being positioned within a perimeter of said first skirt; a cutting blade comprising a sharpened circumferential edge of said second skirt.

In some embodiments the muzzle cap further comprises a shoulder extending circumferentially around an inner surface of said second skirt in spaced relation to said plate. In some embodiments the muzzle cap further comprises a wipe positioned within said second skirt between said shoulder and said plate. Some embodiments of the muzzle cap comprise a plurality of male screw threads are positioned on an outer surface of said first skirt. Some embodiments of the muzzle cap comprise a plurality of female screw threads are positioned on an inner surface of said first skirt. Some embodiments of the muzzle cap comprise said first and second skirts have round cross sectional shapes.

Some embodiments comprise a muzzle device such as a wiped compensator for a firearm. Some embodiments comprise a tube defining a bore, a plurality of vent holes extending through said tube, said tube having a barrel mounting end and a muzzle end; a mounting cap affixed to said barrel mounting end of said tube, said mounting cap adapted to receive a barrel of said firearm; a muzzle cap affixed to said muzzle end of said tube, said muzzle cap defining an opening aligned with said barrel of said firearm; a wipe positioned within said tube adjacent to said muzzle cap.

Some embodiments comprise a cutting blade mounted on one of said tube or said muzzle cap. In some embodiments the wiped compensator comprise a cutting blade mounted on said muzzle end of said tube. In some embodiments of the wiped compensator the cutting blade is integrally formed with said tube. In some embodiments of the wiped compensator the cutting blade comprises a sharpened circumferential edge of said muzzle end of said tube. In some embodiments of the wiped compensator comprise a muzzle cap comprising a plate oriented transversely to said bore, said plate defining said opening, a skirt surrounding said plate and extending transversely thereto; a plurality of female screw threads are positioned on an inner surface of said skirt facing said bore; a plurality of male screw threads are positioned on an outer surface of said tube at said muzzle end thereof, said male screw threads being compatible with said female screw threads for securing said muzzle cap to said tube.

In some embodiments, the wiped compensator may further comprise a shoulder extending circumferentially around said tube within said bore, said shoulder being positioned proximate to said muzzle end of said tube. Some embodiments comprise the wiped compensator wherein said wipe is captured between said shoulder and said muzzle cap. Some embodiments comprise the wiped compensator wherein said cutting blade is mounted on said muzzle cap. Some embodiments comprise the wiped compensator wherein said cutting blade is integrally formed with said muzzle cap. Some embodiments comprise the wiped compensator wherein: said muzzle cap comprises a plate oriented transversely to said bore, said plate defining said opening; a skirt surrounds said plate and extends transversely thereto; and said cutting blade comprises a sharpened circumferential edge of said skirt. Some embodiments comprise the wiped compensator further comprise: a plurality of male screw threads positioned on an outer surface of said skirt facing away from said bore; a plurality of female screw threads positioned on an inner surface of said tube at said muzzle end thereof, said female screw threads being compatible with said male screw threads for securing said muzzle cap to said tube. Some embodiments of the wiped compensator further comprise a shoulder extending circumferentially around an inner surface of said skirt in spaced relation to said plate.

Some embodiments of the wiped compensator further comprise wipe positioned within said muzzle cap, said wipe being between said shoulder and said plate. Some embodiments comprise the wiped compensator wherein: said muzzle cap comprises a plate oriented transversely to said bore, said plate defining said opening; a first skirt surrounds said plate and extends transversely thereto, said first skirt engaging said muzzle end of said tube for attaching said muzzle cap thereto; a second skirt extends transversely to said plate and surrounds said opening, said second skirt being positioned within a perimeter of said first skirt; and said cutting blade comprises a sharpened circumferential edge of said second skirt.

Some embodiments of the wiped compensator further comprise a shoulder extending circumferentially around an inner surface of said second skirt in spaced relation to said plate. Some embodiments comprise the wiped compensator wherein said wipe is positioned within said second skirt, said wipe being captured between said shoulder and said plate.

Some embodiments comprise the wiped compensator wherein: a plurality of male screw threads are positioned on an outer surface of said first skirt facing away from said bore; a plurality of female screw threads are positioned on an inner surface of said tube at said muzzle end thereof, said female screw threads being compatible with said male screw threads for securing said muzzle cap to said tube. Some embodiments comprise the wiped compensator wherein: a plurality of female screw threads are positioned on an inner surface of said first skirt facing toward said bore; a plurality of male screw threads are positioned on an outer surface of said tube at said muzzle end thereof, said female screw threads being compatible with said male screw threads for securing said muzzle cap to said tube. Some embodiments comprise the wiped compensator wherein said tube has a round cross sectional shape. Some embodiments comprise the wiped compensator wherein said skirt has a round cross sectional shape. Some embodiments comprise the wiped compensator wherein said first and second skirts have round cross sectional shapes.

Some of the embodiments comprise a method of preparing a wipe for use in a firearm suppressor or a wiped compensator. Some embodiments comprise removing a muzzle cap from a muzzle end of said suppressor or said wiped compensator to expose a cutting edge on said muzzle cap. Some embodiments comprise forcing said cutting edge into a substrate comprising material suitable for a firearm wipe, said cutting edge separating said wipe from said substrate. Some embodiments further comprising placing said wipe within said suppressor or said wiped compensator adjacent to said muzzle cap. Some embodiments comprise replacing said muzzle cap on said muzzle end of said suppressor or said wiped compensator.

Some embodiments comprise a method of preparing a wipe for use in a firearm suppressor or a wiped compensator. Some embodiments comprise removing a muzzle cap from a muzzle end of said suppressor or said wiped compensator to expose a cutting edge on said suppressor or said wiped compensator. Some embodiments comprise forcing said cutting edge into a substrate comprising material suitable for a firearm wipe, said cutting edge separating said wipe from said substrate. Some embodiments further comprising placing said wipe within said suppressor or said wiped compensator adjacent to said muzzle cap. Some embodiments further comprise replacing said muzzle cap on said muzzle end of said suppressor or said wiped compensator.

Some embodiments comprise a method of channeling muzzle blast gas. Some embodiments comprise providing a firearm with a compensator selectively coupled to the firearm. In some embodiments a bore extends from the firing axis of the firearm through the compensator. In some embodiments the compensator comprises at least one aperture in the side of the compensator. In some embodiments the aperture comprise vents configured to direct muzzle blast gases emitted when a projectile leaves the bore. In some embodiments the vents direct the gases in a direction to oppose muzzle rise. In some embodiments the vents direct the gases to mix to reduce muzzle flash. In some embodiment placing a wipe in the compensator on the distal end of the firearm directs a larger amount of the gas through the vents and reduces the amount of gas that exits along the firing axis. In some embodiments the wipe is placed transverse the primary axis of the bore to act as a barrier to the gases exiting in the distal end of the compensator in the direction of the bullet or projectile. In some embodiments the wipe is configured to direct the muzzle blast gases away from the end of the compensator and back through the at least one vent so as to channel the muzzle blast gases created when a bullet is fired.

In some embodiments the method further comprises reducing the recoil of a firearm by directing the force vector created by the muzzle blast gases away from the distal end of the compensator.

In closing, it is to be understood that the embodiments of the disclosure disclosed herein are illustrative of the principles of the present disclosure. Other modifications that may be employed are within the scope of the disclosure. Thus, by way of example, but not of limitation, alternative configurations of the present disclosure may be utilized in accordance with the teachings herein. Accordingly, the present disclosure is not limited to that precisely as shown and described.

The invention claimed is:

1. A muzzle device, comprising:

a body member including:

a muzzle end, a barrel mounting end, wherein a primary axis of the body member extends from the muzzle end to the barrel mounting end, a bore formed along the primary axis of the body member, a tube formed along the primary axis of the body member and connecting the muzzle end to the barrel mounting end, wherein a plurality of vents is formed in the tube of the body member, the plurality of vents being distributed around the tube, and a rigid wall defining a fixed dimension of an aperture within the body member and transverse the bore; and at least one wipe disposed in the aperture.

2. The muzzle device of claim 1, wherein the muzzle device forms a muzzle of a firearm.

3. The muzzle device of claim 1, further comprising:

a mounting cap affixed to the barrel mounting end of the body member.

4. The muzzle device of claim 3, wherein the mounting cap is adapted to receive a barrel of a firearm.

5. The muzzle device of claim 2, further comprising:

a muzzle cap affixed to the muzzle end of the body member wherein the muzzle cap defines an opening aligned with a barrel of the firearm to permit projectile egress.

6. The muzzle device of claim 1, wherein the aperture comprises a plane that transversely crosses the primary axis of the body member.

7. The muzzle device of claim 1, further comprising:

a coupling mechanism configured to selectively couple the muzzle device to a firearm.

8. The muzzle device of claim 1, further comprising:

a cap configured to enclose the aperture.

9. The muzzle device of claim 8, wherein the aperture is disposed in the cap.

10. The muzzle device of claim 8, wherein the cap is configured to thread onto a muzzle.

11. The muzzle device of claim 1, wherein the plurality of vents are arranged in a semicircle along the tube.

12. The muzzle device of claim 1, wherein the bore is devoid of baffling.

13. The muzzle device of claim 1, wherein:

the plurality of vents are distributed across a radial axis that is perpendicular to and centered around the primary axis of the body member, and the at least one wipe is configured to direct a muzzle blast gas through the plurality of vents in one or more directions that are perpendicular to the primary axis of the body member.

14. A muzzle device, comprising:

a tube defining a bore, wherein the tube has a barrel mounting end and a muzzle end, wherein the tube and the bore extend along a primary axis of the muzzle device, and wherein a plurality of vents is formed in the tube, the plurality of vents being distributed around the tube;

a mounting cap affixed to the barrel mounting end of the tube, wherein the mounting cap is adapted to receive a barrel of a firearm; and a muzzle cap affixed to the muzzle end of the tube, wherein the muzzle cap defines an opening aligned with the barrel of the firearm to permit projectile egress, wherein a receiving slot is defined at least partially by a rigid side wall defining a fixed width of the receiving slot and the muzzle cap, and wherein the muzzle cap is configured to be removable from the muzzle end of the tube to expose the receiving slot for reception of at least one wipe.

15. The muzzle device of claim 14, wherein the at least one wipe is disposed in the receiving slot.

16. The muzzle device of claim 14, wherein the tube is selectively coupleable to a muzzle of the firearm.

17. The muzzle device of claim 14, wherein:

the plurality of vents are distributed across a radial axis that is perpendicular to and centered around the primary axis of the muzzle device, and the plurality of vents are configured to direct muzzle blast gases in one or more directions that are perpendicular to the primary axis of the muzzle device.

18. A method of channeling muzzle blast gases, comprising:

providing a firearm and a muzzle device, wherein a bore extends along a primary axis of the firearm and through the muzzle device, wherein the muzzle device comprises a plurality of vents, the plurality of vents being distributed around the muzzle device and being configured to direct muzzle blast gases; and removing a muzzle cap from a muzzle end of the muzzle device to expose a receiving slot for receiving a wipe, the receiving slot being transverse to the primary axis of the firearm and formed at least partially by a rigid wall defining a width of the receiving slot and the muzzle cap.

19. The method of claim 18, further comprising:

firing the firearm, wherein the wipe directs the muzzle blast gases through the plurality of vents in one or more directions that are perpendicular to the primary axis of the firearm, wherein a recoil of the firearm is reduced based at least in part on the muzzle blast gases being directed in the one or more directions.

20. The method of claim 18, further comprising:

placing, based at least in part on removing the muzzle cap, at least one wipe in the receiving slot; and replacing, based at least in part on placing the at least one wipe in the receiving slot, the muzzle cap on the muzzle end of the muzzle device to close the receiving slot.

* * * * *